United States Patent [19]

Vail, Sr. et al.

[11] Patent Number: 5,022,540

[45] Date of Patent: Jun. 11, 1991

[54] STACKABLE WIRE CUBES FOR USE IN A MODULAR DISPLAY RACK

[76] Inventors: Kenneth E. Vail, Sr., 2560 Lomitas Way, Covina, Calif. 91724; Kenneth E. Vail, Jr., 758 Level Ave., Covina, Calif. 91723

[21] Appl. No.: 569,075

[22] Filed: Aug. 17, 1990

[51] Int. Cl.[5] ..... A47F 5/00

[52] U.S. Cl. ..... 211/181; 206/513; 211/194

[58] Field of Search ..... 211/181, 194, 188; 220/19; 206/513

[56] References Cited

U.S. PATENT DOCUMENTS

| | | | |
|---|---|---|---|
| 2,529,267 | 11/1950 | Sloane | 211/181 X |
| 3,314,549 | 4/1967 | Goldreich et al. | 211/181 X |
| 3,704,791 | 12/1972 | Young | 211/181 X |
| 4,298,127 | 11/1981 | Upshaw et al. | 211/181 X |
| 4,444,320 | 4/1984 | Chap | 211/194 X |
| 4,508,230 | 4/1985 | Ashton | 211/194 X |
| 4,655,351 | 4/1987 | Walker | 211/181 X |
| 4,705,178 | 11/1987 | Vail et al. | 211/194 X |
| 4,805,785 | 2/1989 | Pfeifer et al. | 211/181 X |
| 4,940,148 | 7/1990 | Alperson | 211/181 |
| 4,943,029 | 7/1990 | Szuster | 211/181 X |

*Primary Examiner*—Robert W. Gibson, Jr.
*Attorney, Agent, or Firm*—W. Edward Johansen

[57] ABSTRACT

A stackable wire cube is for use in a modular display rack for displaying and selling merchandise and includes a flat, solid base, a first set of a first plurality of elongated members, a second set of a first plurality of elongated members and a second plurality of inverted U-shaped members. Each elongated member is formed from a steel wire. Each inverted U-shaped member is formed from a steel wire and has a first side portion, a second side portion and a top portion. The first and second side portions have a first top end and a second top end, respectively, and a first bottom end and a second bottom end, respectively. The top portion is adjacent to the first and second top ends of the first and second side portions. Prior to having been formed into the inverted U-shaped members the steel wires were disposed parallel to and spaced apart from each other a particular distance so that the first and second sets of elongated members are disposed parallel to, coaxially aligned with and spaced apart from each other a particular distance and are mechanically coupled to first and second side portions, respectively, to form vertical rows and horizontal columns of criss-crossing steel wires. The steel wires at the first and second top ends are bent to form the inverted U-shaped members and at the first and second bottom ends are bent to form an offset. The flat, solid base is formed out of sheet metal and is mechanically coupled to the U-shaped members at the first and second bottom ends to form the stackable wire cube.

1 Claim, 2 Drawing Sheets

STACKABLE WIRE CUBES FOR USE IN A MODULAR DISPLAY RACK

BACKGROUND OF THE INVENTION

1. Field of the Invention

The present invention relates to a stackable wire cube which are used in a modular display rack for displaying and selling merchandise and more particularly to a stackable wire cube which has a flat, solid base and which is more easily fabricated than the prior art stackable wire cube of the U.S. Pat. No. 4,705,178.

DESCRIPTION OF THE PRIOR ART

U.S. Pat. No. 4,705, 178, entitled Wire Cube for Use in a Modular Display Rack, issued to Kenneth E. Vail, Sr. and Kenneth E. Vail, Jr. on Nov. 10, 1987, teaches a wire cube which includes a pair of screens. Each screen is formed out of a steel grid in which a plurality of steel wires are arranged in both vertical rows and in horizontal columns. Each vertical row is spaced apart a particular distance from each adjacent vertical row. Each horizontal column is spaced apart a particular distance from each adjacent horizontal column. Each vertical row criss-crosses each horizontal column. The steel grid is disposed on a rectangular member which is formed out of steel wire. The pair of screens are spaced apart. The wire cube also includes a plurality of rectangular spacing members which are also formed out of steel wire. The rectangular spacing members are affixed to the pair of spaced-apart screens and are coaxially aligned with each other, but are off-set from the pair of spaced-apart screens in order to form a male end and a female end so that at least two wire cubes may be joined together to form a modular display rack.

U.S. Pat. No. 2,606,683, entitled Stackable Receptacle, issued to Albert V Rudd on Aug. 12, 1952, teaches a plurality of stackable receptacles which can be stacked on each other in multiple-high stacks for storing and displaying merchandise. Each stackable receptacle includes a frame which is adapted to be mechanically coupled to the frame of another stackable receptacle.

U.S. Pat. No. 4,079,836, U.S. Pat. No. 2,529,267, U.S. Pat. No. 4,508,230, U.S. Pat. No. 4,529,088, U.S. Pat. No. 3,314,549 also teach a plurality of stackable receptacles which can be stacked on each other in multiple-high stacks for storing and displaying merchandise.

U.S. Pat. No. 4,313,544, entitled Display Rack, issued to Richard D. A. Ashton on Feb. 2, 1982, teaches a display rack which has a back wall and at least two side walls. The display rack has a plurality of hinge mechanisms which are interconnected between the respective side walls and the back wall. The hinge mechanisms are located at spaced apart intervals so that the side walls may be swung flat against the back wall for shipping and may be swung away therefrom for erection. The shelving is dimensioned in order to fit between the two side walls when the same are swung apart and the shelving has fasteners integral therewith interengageable with the side walls so that the shelving may be secured along either side edge to respective side walls in supporting relation thereto and at the same time interlocking such side walls together in predetermined spaced apart relationship so that they are no longer swingable with respect to the back wall and forming a rigid three-dimensional structure.

U.S. Pat. No. 4,324,076, entitled Wall Units, issued to Rueben Honickman on Apr. 13, 1982, teaches a closet structure which is installed in a building which has an alcove which is defined by a first side wall, a second side wall and a back wall of the building. The closet structure is defined by wall units which are disposed on one of each of the side walls of the alcove with the back wall remaining exposed between the wall units. Each wall unit is in the form of a relatively rigid self-supporting panel which is formed with an array of openings for receiving article supporting elements which are engaged in the opening. Each panel is coupled to the relevant one of the side walls with the outer surface of the panels generally vertical and the inner surface spaced from the wall. The all units may also be used in store for storing and displaying merchandise.

U.S. Pat. No. 4,344,367, entitled Modular Product Display System issued to Milton J. Merl on Aug. 17, 1982, teaches a modular display system for beverage bottles which includes a base assembly and at least two spaced apart upright supporting webs which are detachably connected to the base assembly.

U.S. Pat. No. 4,351,244, entitled Shelving System, issued to James A. Shuttles on Sept. 28, 1982, teaches a four-post merchandiser which includes two light-gauge sheet metal corner posts which are reinforced against twisting by a dual camming action by which the two posts are urged tightly against the corners of the shelves.

U.S. Pat. No. 4,359,947, entitled Shelving Assembly, issued to Howard J. Merschak on Nov. 23, 1982, teaches a shelving assembly which is used for displaying or storing merchandise in commercial establishments in any of several ways which are tailored to meet the needs of that establishment. The components are capable of being combined to provide with any selected number of either inclined shelves or horizontal shelves.

U.S. Pat. No. 4,379,431, entitled Shelving Assembly, issued to John J. Clement on Apr. 12, 1983, teaches a shelving assembly which includes vertically disposed corner posts which are interconnected at their bottom ends by header panels. The shelving assembly is used for displaying or storing merchandise in commercial establishments.

U.S. Pat. No. 4,384,751, entitled Shelving Units and Their Use in Display Cabinets and Rearrangeable Shop Fitting, issued to Rita Cunterman and Hermann Siekmann on May 24, 1983, teaches a shelving unit which includes a pair of ladder-like members each of which is formed from two vertical elements which are connected by a plurality of horizontal elements. Several interchangeable generally rectangular shelves rest upon respectively opposed pair of the horizontal elements.

U.S. Pat. No, 4,430,947, entitled Shelf Support System, issued to Martin C. Kvame on Feb. 14, 1984, teaches a support system for shelving which includes a first female element which is attached to the side wall or other wall of a display stand and a second male element which is attached to the sides or ends of shelving which is provided for the display stand. The support system elements are designed so that they may be snapped together when the display stand is being assembled and slid apart when display stand is being disassembled.

U.S. Pat. No. 4,444,322, entitled Display Rack, issued to Vernon E. Lee on Apr. 24, 1984, teaches a display rack for retail food merchandise which is assembled upon a novel adjustable frame structure. The display rack includes a pair of end structure assemblies and a pair of center structure assemblies each of which includes a vertical support member which is attached to upper and lower horizontally extendable members. The center structure assemblies are placed between and perpendicular to the end structure assemblies which are positioned parallel to each other. Each center structure assembly is securably attachable to its adjacent end structure assemblies.

U.S. Pat. No. 4,450,775, entitled Merchandise Display Rack, issued to David A. Brendle on May 29, 1984, teaches a merchandise display rack which is constructed of prefabricated material for use in displaying merchandise and/or printed material in stores and malls. Modular construction permits tailoring the size of the merchandise display rack according to individual needs.

U.S. Pat. No. 3,653,734, entitled Modular Furniture, issued to Nicholas A. Ungaro on Apr. 4, 1972, teaches modular furniture which includes a first plurality of H-shaped members, a second plurality of cannisters and a third plurality of drawers and which is assembled in a number of different designs from certain standard components. Each H-shaped frame is adapted to support and hold one of the canisters into which one of the drawers is placed. A lip structure on each canister locks it to the H-shaped frame.

U.S. Pat. No. 4,940,148, entitled Retail Display Wire Cube, issued to Joel H. Alperson on Jul. 10, 1990, teaches retail display wire cubes each of which has upright sideward grids effected into spaced-apart parallel relationship with co-axially aligned rectangular spacing members that extend above and below the grids. The retail display wire cubes are adapted for secure removable attachment to a similar wire cube stacked immediately therebelow with U-shaped having vertical wings carried by terminal spacing members at locations below a grid and each clip including a toe-like lower-terminus projecting transversely outwardly from the vertical wings.

SUMMARY OF THE INVENTION

In view of the foregoing factors and conditions which are characteristic of the prior art it is the primary object of the present invention to provide a stackable wire cube which is used in a modular display rack for displaying and selling merchandise and which is more easily fabricated than the prior art stackable wire cube of the U.S. Pat. No. 705,178.

It is another object of the present invention to provide a stackable wire cube which has a flat, solid base.

In accordance with the present invention an embodiment of a stackable wire cube is for use in a modular display rack for displaying and selling merchandise is described. The stackable wire cube includes a flat, solid base, a first set of a first plurality of elongated members, a second set of a first plurality of elongated members and a second plurality of inverted U-shaped members. Each elongated member is formed from a steel wire. Each inverted U-shaped member is formed from a steel wire and has a first side portion, a second side portion and a top portion. The first and second side portions have a first top end and a second top end, respectively, and a first bottom end and a second bottom end, respectively. The top portion is adjacent to the first and second top ends of the first and second side portions. Prior to having been formed into the inverted U-shaped members the steel wires were disposed parallel to and spaced apart from each other a particular distance so that the first and second sets of elongated members are disposed parallel to, coaxially aligned with and spaced apart from each other a particular distance and are mechanically coupled to first and second side portions, respectively, to form vertical rows and horizontal columns of criss-crossing steel wires. The steel wires at the first and second top ends are bent to form the inverted U-shaped members and at the first and second bottom ends are bent to form an offset. The flat, solid base is formed out of sheet metal and is mechanically coupled to the U-shaped members at the first and second bottom ends to form the stackable wire cube.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
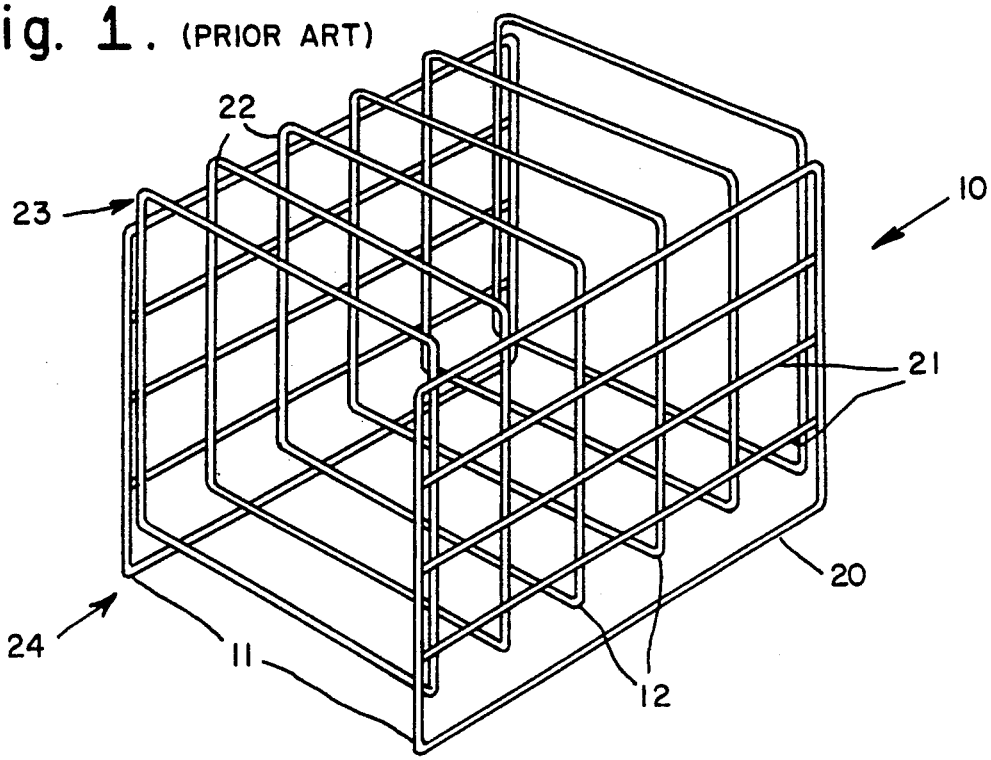
Fig. 1. (PRIOR ART)
FIG. 1 is a perspective drawing of a wire cube of the prior art which has been constructed in accordance with the principles of the U.S. Pat. No. 4,705,178 and a plurality of which are used in assembling a modular display rack.

In order to understand the present invention it is necessary to refer to the following description of the prior art wire cube of U.S. Pat. No. 4,705,178 in conjunction with the accompanying drawing. Referring to FIG. 1 a prior art wire cube 10 includes a pair of screens 11 and a plurality of rectangular spacing members 12. Each screen 11 is formed out of a steel grid 20 in which a plurality of steel wires 21 are arranged in a horizontal columns. Each steel wire 21 is spaced apart a particular distance from the adjacent steel wire 21. Each rectangular spacing member 12 includes a plurality of steel wires 22 which are arranged in vertical rows. Each steel wire 22 is spaced apart a particular distance from the adjacent steel wire 22. Each steel wire 21 in a horizontal column criss-crosses each steel wire 22 in a vertical row. The rectangular spacing members 12 are affixed to the pair of spaced-apart screens 11 and are coaxially aligned with each other, but are off-set from the pair of spaced-apart screens 11 in order to form a male end 23 and a female end 24 so that at least two prior art wire cubes 10 may be joined together to form a modular display rack.

Figure 2:
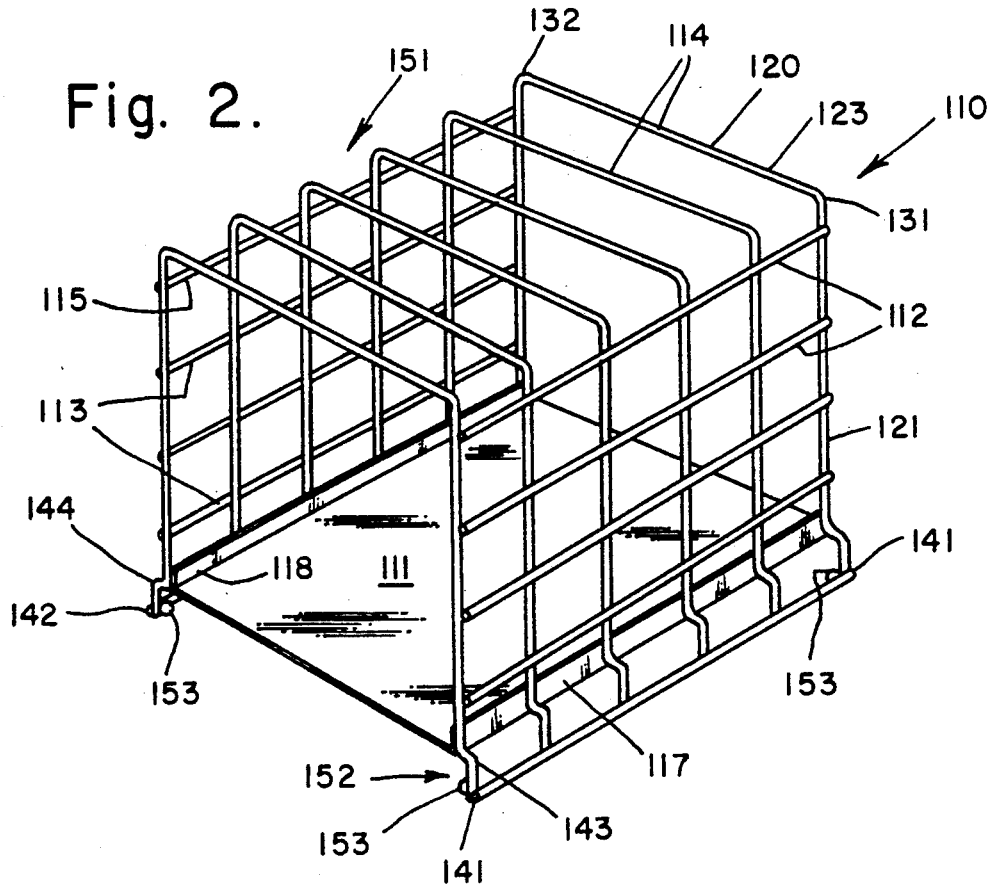
FIG. 2 is a perspective drawing of a stackable wire cube which has been constructed in accordance with the principles of the present invention and a plurality of which are used in assembling a modular display rack.

It is also necessary to refer to the following description of its preferred embodiment in conjunction with the accompanying drawing. Referring to FIG. 2 a stackable wire cube 110 is for use in a modular display rack for displaying and selling merchandise and includes a flat, solid base 111, a first set 112 of a first plurality of elongated members, a second set 113 of a first plurality of elongated members and a second plurality 114 of inverted U-shaped members. Each elongated member 115 is formed from a steel wire. The flat, solid base 116 has a first folded-up side 117 along its peripheral edge and a second folded-up side 118 along its peripheral edge. Each inverted U-shaped member 120 is formed from a steel wire and has a first side portion 121, a second side portion 122 and a top portion 123. The first and second side portions have a first top end 131 and a second top end 132, respectively, and a first bottom end 141 and a second bottom end 142, respectively. The top portion 123 is adjacent to the first and second top ends 131 and 132 of the first and second side portions 121 and 122. Prior to having been formed into the inverted U-shaped members 120 the steel wires were disposed parallel to and spaced apart from each other a particular distance so that the first and second sets 112 and 113 of elongated members 115 are disposed parallel to, coaxially aligned with and spaced apart from each other a particular distance and are mechanically coupled to first and second side portions 121 and 122, respectively, to form vertical rows and horizontal columns of criss-crossing steel wires. The steel wires at the first and second top ends 131 and 132 are bent to form the inverted U-shaped members 120 and at the first and second bottom ends are bent to form first offsets 143 and second offsets 144. The flat, solid base 111 is formed out of sheet metal is mechanically coupled to the U-shaped members 120 at the first and second bottom ends 141 and 142 to form the stackable wire cube 110. Alternatively, the flat, solid base 116 may also have a first folded-down side along its peripheral edge and a second folded-down side along its peripheral edge.

Figure 3:
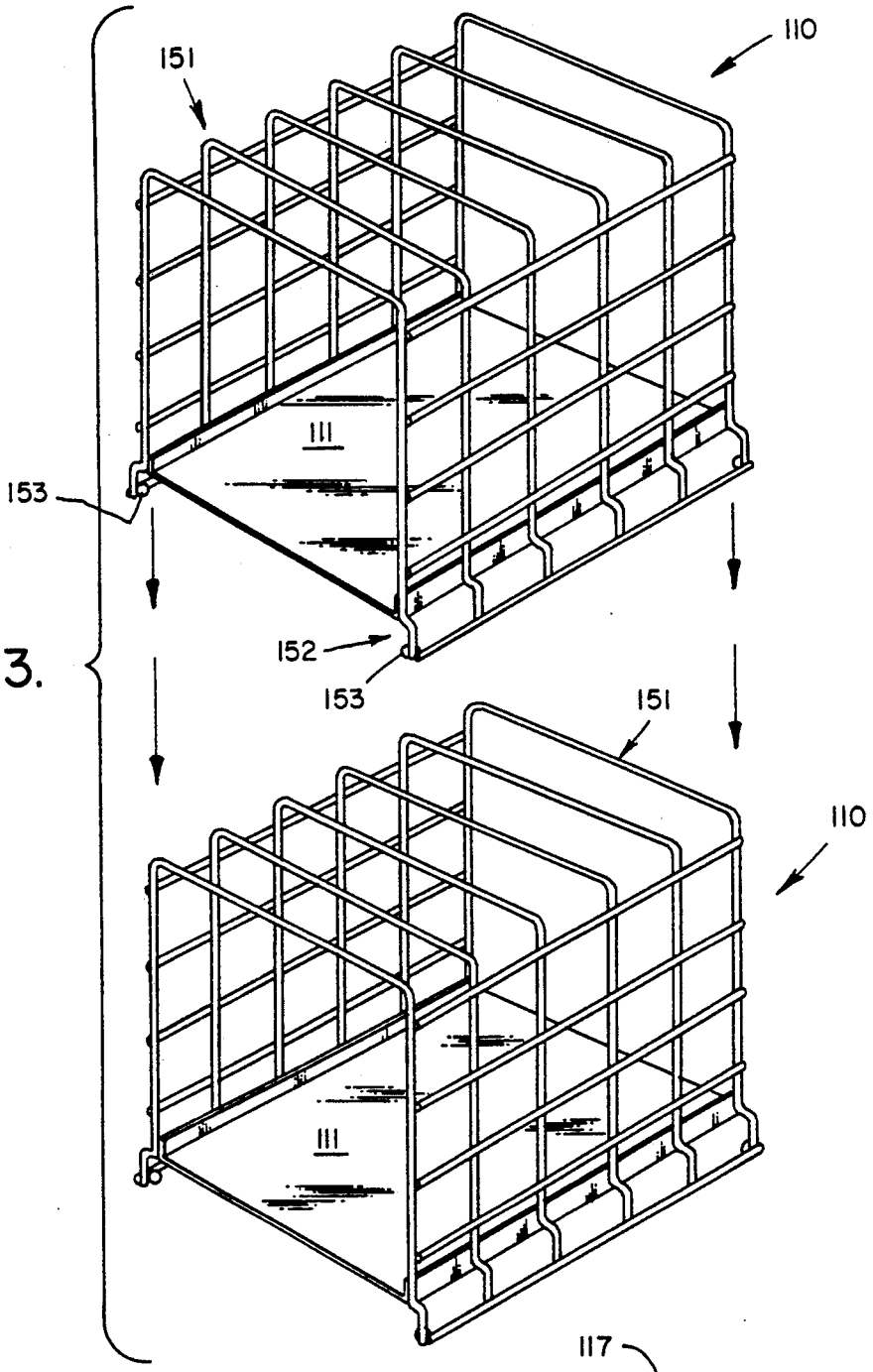
FIG. 3 is a perspective drawing of two of the stackable wire cubes of FIG. 2 which are shown with a female end of one of the wire cubes interconnecting with the male end of another wire cube.
Figure 4:
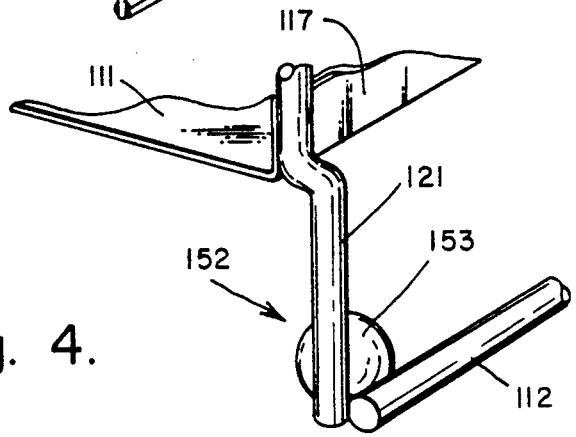
FIG. 4 is enlarged perspective drawing of the right front, bottom corner of the stackable wire cubes of FIG. 2.

Referring to FIG. 3 in conjunction with FIG. 1 and FIG. 4. the first and second side portion 121 and 122 of the inverted U-shaped members 120 and the top portion 123 form a male end 151 and the first and second offsets 143 and 144 at the first and second bottom ends 141 and 142 form a female end 152 so that at least two stackable wire cubes 110 may be joined together to form a modular display rack. One of four steel balls 153 is disposed in each bottom corner of the stackable cube in order to prevent two adjacent stackable wire cubes 110 from sliding relative to one another. The flat, solid base 116 may also have a folded-down front 157 along its peripheral edge and a folded-down rear 158 along its peripheral edge in order to replace the four steel balls 153.

From the foregoing it can be seen that stackable wire cubes are used in assembling a modular display rack have been described. Among the advantages of the stackable wire cubes are that they are not only more quickly and more easily fabricated than the prior art stackable wire cubes of U.S. Pat. No. 4,705,178, but also retain all of the advantages of the prior art stackable wire cubes. The flat, solid base of the stackable wire cube is also an advantage because generally the displayer and seller of merchandise had placed a rigid sheet of material on the base of each prior art stackable wire cube. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A stackable wire cube comprising:

a. a first set of a first plurality of elongated members each of which is formed from a steel wire;

b. a second set of a first plurality of elongated members each of which is formed from a steel wire;

c. a second plurality of inverted U-shaped members each of which is formed from a steel wire and has a first side portion with a first top end and a first bottom end, a second side portion with a second top end and a second bottom end and a top portion which is adjacent to said first and second top ends of said first and second side portions, prior to having been formed into said inverted U-shaped members said steel wires were disposed parallel to and spaced apart from each other a particular distance so that said first and second sets of elongated members are disposed parallel to, coaxially aligned with and spaced apart from each other a particular distance and are mechanically coupled to said first and second side portions, respectively, of said inverted U-shaped members to form vertical rows and horizontal columns of criss-crossing steel wires wherein said steel wires at said first and second top ends are bent to form said inverted U-shaped members and at said first and second bottom ends are bent to form an offset; and d. a base which is formed out of sheet metal is mechanically coupled to said U-shaped members at said first and second bottom ends to form said stackable wire cube.

* * * * *